US009338554B2

(12) United States Patent
Christoph

(10) Patent No.: US 9,338,554 B2
(45) Date of Patent: May 10, 2016

(54) SOUND SYSTEM FOR ESTABLISHING A SOUND ZONE

(71) Applicant: Harman Becker Automotive Systems GmbH, Karlsbad (DE)

(72) Inventor: Markus Christoph, Straubing (DE)

(73) Assignee: HARMAN BECKER AUTOMOTIVE SYSTEMS GMBH, Karlsbad (DE)

( * ) Notice: Subject to any disclaimer, the term of this patent is extended or adjusted under 35 U.S.C. 154(b) by 80 days.

(21) Appl. No.: 14/281,325

(22) Filed: May 19, 2014

(65) Prior Publication Data

US 2014/0348329 A1 Nov. 27, 2014

(30) Foreign Application Priority Data

May 24, 2013 (EP) ..... 13169200

(51) Int. Cl.

| | |
|---|---|
| ***H04R 5/00*** | (2006.01) |
| ***H04S 7/00*** | (2006.01) |
| *H04S 1/00* | (2006.01) |
| *H04S 3/00* | (2006.01) |

(52) U.S. Cl.

CPC *H04R 5/00* (2013.01); *H04S 7/301* (2013.01); *H04R 2499/13* (2013.01); *H04S 1/007* (2013.01); *H04S 3/008* (2013.01); *H04S 2420/01* (2013.01)

(58) Field of Classification Search

None

See application file for complete search history.

(56) References Cited

U.S. PATENT DOCUMENTS

| | | | | |
|---|---|---|---|---|
| 5,727,066 | A | 3/1998 | Elliott et al. | |
| 6,760,451 | B1 | 7/2004 | Craven et al. | |
| 7,561,706 | B2 | 7/2009 | Holmi et al. | |
| 2003/0161478 | A1 * | 8/2003 | Nelson | H04S 5/00 381/17 |
| 2004/0179693 | A1 * | 9/2004 | Abel | H04S 1/002 381/1 |

(Continued)

FOREIGN PATENT DOCUMENTS

EP 1395081 A1 3/2004

OTHER PUBLICATIONS

European Patent Office, European search report, Application No. 13169200.6-1910, dated Aug. 23, 2013.

(Continued)

*Primary Examiner* — Thang Tran

(74) *Attorney, Agent, or Firm* — Artegis Law Group, LLP

(57) ABSTRACT

In the described technique, electrical audio signals are processed by inverse filtering according to three filter matrices, each handling a frequency range or sample rate or both. Loudspeakers, arranged at separate positions separate within or near the sound zones, convert the electrical audio signals into corresponding acoustic audio signals. Then each of the acoustic audio signals is transferred according to a transfer matrix from each of the loudspeakers to each of the sound zones, where the transferred acoustic signals contribute to the corresponding reception sound signals. The three filter matrices are configured to compensate for the transfer matrix so that each one of the reception sound signals corresponds to one of the electrical audio signals.

15 Claims, 5 Drawing Sheets

(56) References Cited

U.S. PATENT DOCUMENTS

| | | | | |
|---|---|---|---|---|
| 2005/0281408 | A1* | 12/2005 | Kim | H04S 3/002 381/17 |
| 2007/0019812 | A1* | 1/2007 | Kim | H04S 1/00 381/17 |
| 2007/0025559 | A1* | 2/2007 | Mihelich | H04S 7/307 381/59 |
| 2007/0076892 | A1* | 4/2007 | Kim | H04R 5/04 381/17 |
| 2007/0110250 | A1* | 5/2007 | Bauck | H04S 3/02 381/20 |
| 2007/0133831 | A1* | 6/2007 | Kim | H04S 3/02 381/313 |
| 2008/0025534 | A1* | 1/2008 | Kuhn | H04S 7/30 381/300 |
| 2009/0271005 | A1* | 10/2009 | Christensen | G10L 21/00 700/19 |
| 2010/0290643 | A1* | 11/2010 | Mihelich | H04S 7/301 381/99 |
| 2012/0008806 | A1 | 1/2012 | Hess | |
| 2013/0179163 | A1* | 7/2013 | Herbig | H04R 3/005 381/86 |
| 2013/0259254 | A1* | 10/2013 | Xiang | G10K 11/175 381/73.1 |

OTHER PUBLICATIONS

Gupta, et al..: "Three Dimensional Sound Field Reproduction Using Multiple Circular Loudspeaker Arrays", IEEE, 2010.

Neely, et al.: "Invertibility of a Room Impulse Response", J. Acoust. Soc. Am. 66(1), Jul. 1979, pp. 165-169.

Kim: "Authentic Reproduction of Stereo Sound—A Wiener Filter Approach", 115th Convention of Audio Engineering Society, Convention Paper 595, New York, New York, Oct. 2003.

Parodi, et al.: "Objective Evaluation of the Sweet Spot Size in Spatial Sound Reproduction Using Elevated Loudspeakers", J. Acout. Soc. Am. 128(3), Sep. 2010.

Farina, et al.: "Ambiophonic Principles for the Recording and Reproduction of Surround Sound for Music", AES 19th International Conference.

Cooper, et al.: "Prospects for Transaural Recording", J. Audio Eng. Soc., vol. 27, No. 1/2, Jan./Feb. 1989, pp. 3-19.

Takeuchi, et al.: "Subjective and Objective Evaluation of the Optimal Source Distribution for Virtual Acoustic Imaging", J. Audio Eng. Soc., vol. 55, No. 11, Nov. 2007, pp. 981-997.

Kirkeby, et al.: "Fast Deconvolution of Multichannel Systems Using Regularization", IEEE Transactions on Speech and Audio Processing, vol. 6, No. 2, Mar. 1998, pp. 189-195.

* cited by examiner

SOUND SYSTEM FOR ESTABLISHING A SOUND ZONE

BACKGROUND

1. Technical Field

The disclosure relates to a system and method (generally referred to as a "system") for processing a signal.

2. Related Art

Spatially limited regions inside a space typically serve various purposes regarding sound reproduction. A field of interest in the audio industry is the ability to reproduce multiple regions of different sound material simultaneously inside an open room. This is desired to be obtained without the use of physical separation or the use of headphones, and is herein referred to as "establishing sound zones". A sound zone is a room or area in which sound is distributed. More specifically, arrays of loudspeakers with adequate preprocessing of the audio signals to be reproduced are of concern, where different sound material is reproduced in predefined zones without interfering signals from adjacent ones. In order to realize sound zones, it is necessary to adjust the response of multiple sound sources to approximate the desired sound field in the reproduction region. A large variety of concepts concerning sound field control have been published, with different degrees of applicability to the generation of sound zones.

SUMMARY

A sound system for acoustically reproducing k electrical audio signals (where k=2, 3, 4, . . . ) and establishing k sound zones, in each of which one of k reception sound signals occurs that is an individual pattern of the reproduced and transmitted k electrical audio signals, comprising a signal processing arrangement that is configured to process the k electrical audio signals to provide k processed electrical audio signals and k loudspeakers that are arranged at positions separate from each other and within or adjacent to the k sound zones, each configured to convert the k processed electrical audio signals into corresponding k acoustic audio signals. Each of the k acoustic audio signals is transferred according to a transfer matrix from each of the k loudspeakers to each of the k sound zones, where they contribute to the corresponding reception sound signals. Processing of the k electrical audio signals, which provides k processed electrical audio signals, comprises inverse filtering according to three filter matrices, one of which is an i×i filter matrix, one is a j×j filter matrix and one is a k×k filter matrix, in which i, j<k. Each of the i×i and j×j filter matrices is configured to digitally process a share of the k electrical audio signals in a first frequency range or at a first sampling rate or both, or in a second frequency range or at a second sampling rate or both, respectively, and the k×k filter matrix is configured to digitally process all k electrical audio signals in a third frequency range or at a third sampling rate or both, the third sampling rate being the lowest of the three sampling rates and an upper frequency limit of the third frequency range being lower than upper frequency limits of the first frequency range and the second frequency range. The three filter matrices are configured to compensate for the transfer matrix so that each one of the reception sound signals corresponds to one of the electrical audio signals.

A method for acoustically reproducing k electrical audio signals (where k=2, 3, 4, . . . ) and establishing k sound zones, in each of which one of k reception sound signals occurs that is an individual pattern of the reproduced and transmitted k electrical audio signals, comprising processing the k electrical audio signals to provide k processed electrical audio signals and converting the k processed electrical audio signals into corresponding k acoustic audio signals with k loudspeakers that are arranged at positions separate from each other and within or adjacent to the k sound zones. Each of the k acoustic audio signals is transferred according to a transfer matrix from each of the k loudspeakers to each of the k sound zones, where they contribute to the corresponding reception sound signals. Processing of the k electrical audio signals, which provides k processed electrical audio signals, comprises inverse filtering according to three filter matrices, one of which is an i×i filter matrix, one is a j×j filter matrix and one is a k×k filter matrix, in which i, j<k. Each of the i×i and j×j filter matrices is configured to digitally process a share of the k electrical audio signals in a first frequency range or at a first sampling rate or both, or in a second frequency range or at a second sampling rate or both, respectively, and the k×k filter matrix is configured to digitally process all k electrical audio signals in a third frequency range or at a third sampling rate or both, the third sampling rate being the lowest of the three sampling rates and an upper frequency limit of the third frequency range being lower than upper frequency limits of the first frequency range and the second frequency range. The three filter matrices are configured to compensate for the transfer matrix so that each one of the reception sound signals corresponds to one of the electrical audio signals.

Other systems, methods, features and advantages will be, or will become, apparent to one with skill in the art upon examination of the following detailed description and figures. It is intended that all such additional systems, methods, features and advantages be included within this description, be within the scope of the invention and be protected by the following claims.

BRIEF DESCRIPTION OF THE DRAWINGS

The system may be better understood with reference to the following description and drawings. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
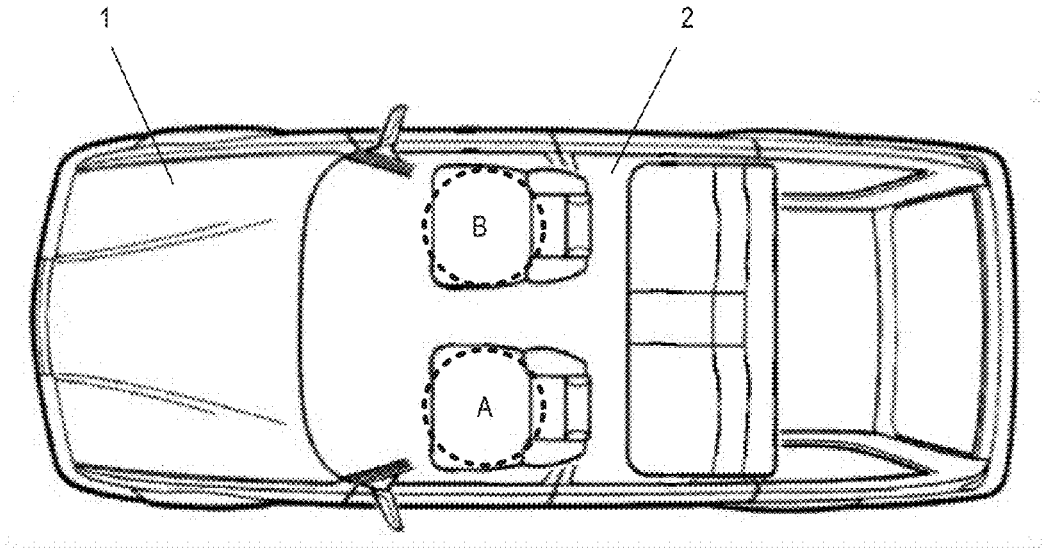
FIG. 1 is a top view of a car cabin with individual sound zones.

Referring to FIG. 1, individual sound zones in an enclosure such as cabin 2 of car 1 are shown, which include in particular two different zones A and B. Sound program A is reproduced in zone A and sound program B is reproduced in zone B. The spatial orientation of the two zones is not fixed. This should adapt to user location and should ideally be able to track the exact position and reproduce the desired sound program in that spatial region of concern.

Certain aspects of an ideal system must be reformulated and delimited in order to obtain the basis for a practical system. For example, a complete separation of the sound fields found in each of the two zones (A and B) is not a realizable condition for a practical system implemented under reverberant conditions. Thus, it is to be expected that the users are subjected to a certain degree of annoyance that is created by adjacent reproduced sound fields.

Figure 2:
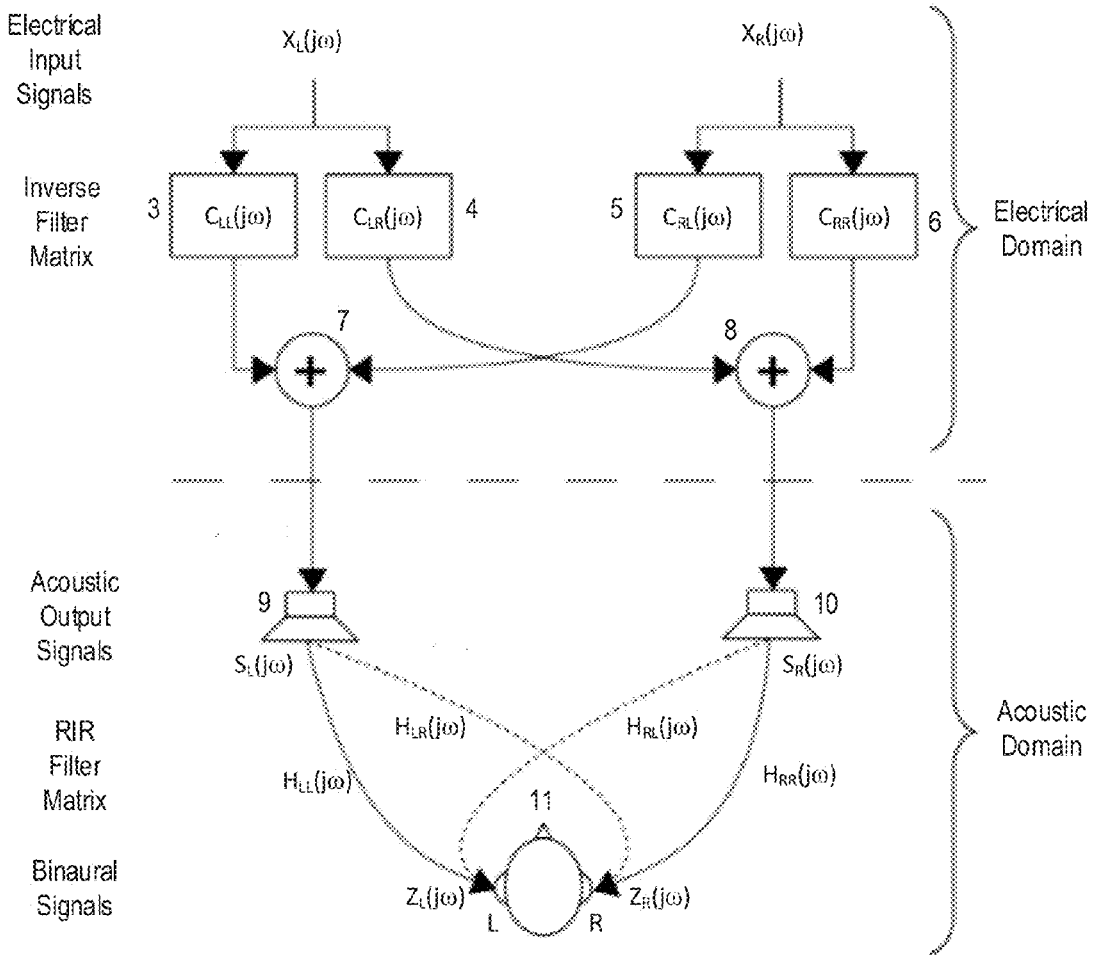
FIG. 2 is a schematic diagram illustrating a 2×2 transaural stereo system.

FIG. 2 illustrates a two-zone (zones L, R) transaural stereo system, i.e., a 2×2 system in which the receiving signals are binaural (stereo), e.g., picked up by the two ears of a human or two microphones arranged on an artificial head at ear positions. The transaural stereo system of FIG. 2 is established around listener 11 from an input electrical stereo audio signal $X_L(j\omega)$, $X_R(j\omega)$ by way of two loudspeakers 9 and 10 in connection with an inverse filter matrix with four inverse filters 3-6 that have transfer functions $C_{LL}(j\omega)$, $C_{LR}(j\omega)$, $C_{RL}(j\omega)$ and $C_{RR}(j\omega)$ and that are connected upstream of the two loudspeakers 9 and 10. The signals and transfer functions are frequency domain signals and functions that correspond with time domain signals and functions. The left electrical input (audio) signal $X_L(j\omega)$ and the right electrical input (audio) signal $X_R(j\omega)$, which may be provided by any suitable audio signal source, such as a radio receiver, music player, telephone, navigation system or the like, are pre-filtered by the inverse filters 3-6. Filters 3 and 4 filter signal $X_L(j\omega)$ with transfer functions $C_{LL}(j\omega)$ and $C_{LR}(j\omega)$, and filters 5 and 6 filter signal $X_R(j\omega)$ with transfer functions $C_{RL}(j\omega)$ and $C_{RR}(j\omega)$ to provide inverse filter output signals. The inverse filter output signals provided by filters 3 and 5 are combined by adder 7, and inverse filter output signals provided by filters 4 and 6 are combined by adder 8 to form combined signals $S_L(j\omega)$ and $S_R(j\omega)$. In particular, signal $S_L(j\omega)$ supplied to the left loudspeaker 9 can be expressed as:

$$S_L(j\omega)=C_{LL}(j\omega)\cdot X_L(j\omega)+C_{RL}(j\omega)\cdot X_R(j\omega), \tag{1}$$

and the signal $S_R(j\omega)$ supplied to the right loudspeaker 10 can be expressed as:

$$S_R(j\omega)=C_{LR}(j\omega)\cdot X_L(j\omega)+C_{RR}(j\omega)\cdot X_R(j\omega). \tag{2}$$

Loudspeakers 9 and 10 radiate the acoustic loudspeaker output signals $S_L(j\omega)$ and $S_R(j\omega)$ to be received by the left and right ear of the listener, respectively. The sound signals actually present at listener 11's left and right ears are denoted as $Z_L(j\omega)$ and $Z_R(j\omega)$, respectively, in which:

$$Z_L(j\omega)=H_{LL}(j\omega)\cdot S_L(j\omega)+H_{RL}(j\omega)\cdot S_R(j\omega), \tag{3}$$

$$Z_R(j\omega)=H_{LR}(j\omega)\cdot S_L(j\omega)+H_{RR}(j\omega)\cdot S_R(j\omega). \tag{4}$$

In equations 3 and 4, the transfer functions $H_{ij}(j\omega)$ denote the room impulse response (RIR) in the frequency domain, i.e., the transfer functions from loudspeakers 9 and 10 to the left and right ear of the listener, respectively. Indices i and j may be "L" and "R" and refer to the left and right loudspeakers (index "i") and the left and right ears (index "j"), respectively.

The above equations 1-4 may be rewritten in matrix form, wherein equations 1 and 2 may be combined into:

$$S(j\omega)=C(j\omega)\cdot X(j\omega), \tag{5}$$

and equations 3 and 4 may be combined into:

$$Z(j\omega)=H(j\omega)\cdot S(jw\omega), \tag{6}$$

wherein $X(j\omega)$ is a vector composed of the electrical input signals, i.e., $X(j\omega)=[X_L(j\omega), X_L(j\omega)]^T$, $S(j\omega)$ is a vector composed of the loudspeaker signals, i.e., $S(j\omega)=[S_L(j\omega), S_L(j\omega)]^T$, $C(j\omega)$ is a matrix representing the four filter transfer functions $C_{LL}(j\omega)$, $C_{RL}(j\omega)$, $C_{LR}(j\omega)$ and $C_{RR}(j\omega)$ and $H(j\omega)$ is a matrix representing the four room impulse responses in the frequency domain $H_{LL}(j\omega)$, $H_{RL}(j\omega)$, $H_{LR}(j\omega)$ and $H_{RR}(j\omega)$. Combining equations 5 and 6 yields:

$$Z(j\omega)=H(j\omega)\cdot C(j\omega)\cdot X(j\omega). \tag{6}$$

From the above equation 6, it can be seen that when:

$$C(j\omega)=H^{-1}(j\omega)\cdot e^{-j\omega\tau}, \tag{7}$$

i.e., the filter matrix $C(j\omega)$ is equal to the inverse of the matrix $H(j\omega)$ of room impulse responses in the frequency domain $H^{-1}(j\omega)$ plus an additionally delay $\tau$ (compensating at least for the acoustic delays), then the signal $Z_L(j\omega)$ arriving at the left ear of the listener is equal to the left input signal $X_L(j\omega)$ and the signal $Z_R(j\omega)$ arriving at the right ear of the listener is equal to the right input signal $X_R(j\omega)$, wherein the signals $Z_L(j\omega)$ and $Z_R(j\omega)$ are delayed as compared to the input signals $X_L(j\omega)$ and $X_R(j\omega)$, respectively.

That is:

$$Z(j\omega)=X(j\omega)\cdot e^{-j\omega\tau}. \tag{8}$$

As can be seen from equation 7, designing a transaural stereo reproduction system includes—theoretically—inverting the transfer function matrix $H(j\omega)$, which represents the room impulse responses in the frequency domain, i.e., the RIR matrix in the frequency domain. For example, the inverse may be determined as follows:

$$C(j\omega)=\det(H)^{-1}\cdot\mathrm{adj}(H(j\omega)), \tag{9}$$

which is a consequence of Cramer's rule applied to equation 7 (the delay is neglected in equation 9). The expression $\mathrm{adj}(H(j\omega))$ represents the adjugate matrix of matrix $H(j\omega)$. One can see that the pre-filtering may be done in two stages, wherein the filter transfer function $\mathrm{adj}(H(j\omega))$ ensures a damping of the crosstalk and the filter transfer function $\det(H)^{-1}$ compensates for the linear distortions caused by the transfer function $\mathrm{adj}(H(j\omega))$. The adjugate matrix $\mathrm{adj}(H(j\omega))$ always results in a causal filter transfer function, whereas the compensation filter with the transfer function $G(j\omega))=\det(H)^{-1}$ may be more difficult to design.

In the example of FIG. 2, the left ear (signal $Z_L$) may be regarded as being located in a first sound zone and the right ear (signal $Z_R$) may be regarded as being located in a second sound zone. This system may provide a sufficient crosstalk damping so that, substantially, input signal $X_L$ is reproduced only in the first sound zone (left ear) and input signal $X_R$ is reproduced only in the second sound zone (right ear). As a sound zone is not necessarily associated with a listener's ear, this concept may be generalized and extended to a multi-dimensional system with more than two sound zones, provided that the system comprises as many loudspeakers (or groups of loudspeakers) as individual sound zones.

Referring again to the car cabin shown in FIG. 1, two sound zones are associated with the front seats of the car. Sound zone A is associated with the driver's seat and sound zone B is associated with the front passenger's seat. When using four loudspeakers and two binaural listeners, i.e., four zones such as those at the front seats in the exemplary car cabin of FIG. 3, equations 6-9 still apply but yield a fourth-order system instead of a second-order system, as in the example of FIG. 2. The inverse filter matrix $C(j\omega)$ and the room transfer function matrix $H(j\omega)$ are then a 4×4 matrix.

As already outlined above, it is very difficult to implement a satisfying compensation filter (transfer function matrix $G(j\omega)=\det(H)^{-1}=1/\det\{H(j\omega)\}$) of reasonable complexity.

One approach is to employ regularization in order not only to provide an improved inverse filter, but also to provide maximum output power, which is determined by regularization parameter $\beta(j\omega)$. Considering only one (loudspeaker-to-zone) channel, the related transfer function matrix $G(j\omega_k)$ reads as:

$$G(j\omega_k)=\det\{H(j\omega_k)\}/(\det\{H(j\omega_k)\}^*\det\{H(j\omega_k)\}+\beta(j\omega_k)), \quad (10)$$

in which $\det\{H(j\omega_k)\}=H_{LL}(j\omega_k)\ H_{RR}(j\omega_k)-H_{LR}(j\omega_k)\ H_{RL}(j\omega_k)$ is the gram determinant of the matrix $H(j\omega_k)$, $k=[0, \ldots, N-1]$ is a discrete frequency index, $\omega_k=2\pi k f_s/N$ is the angular frequency at bin k, $f_s$ is the sampling frequency and N is the length of the fast Fourier transformation (FFT).

Regularization has the effect that the compensation filter exhibits no ringing behavior caused by high-frequency, narrow-band accentuations. In such a system, a channel may be employed that includes passively coupled midrange and high-range loudspeakers. Therefore, no regularization may be provided in the midrange and high-range parts of the spectrum. Only the lower spectral range, i.e., the range below corner frequency $f_c$, which is determined by the harmonic distortion of the loudspeaker employed in this range, may be regularized, i.e., limited in the signal level, which can be seen from the regularization parameter $\beta(j\omega)$ that increases with decreasing frequency. This increase towards lower frequencies again corresponds to the characteristics of the (bass) loudspeaker used. The increase may be, for example, a 20 dB/decade path with common second-order loudspeaker systems. Bass reflex loudspeakers are commonly fourth-order systems, so that the increase would be 40 dB/decade. Moreover, a compensation filter designed according to equation 10 would cause timing problems, which are experienced by a listener as acoustic artifacts.

The individual characteristic of a compensation filter's impulse response results from the attempt to complexly invert $\det H(j\omega)$, i.e., to invert magnitude and phase despite the fact that the transfer functions are commonly non-minimum phase functions. Simply speaking, the magnitude compensates for tonal aspects and the phase compresses the impulse response ideally to Dirac pulse size. It has been found that the tonal aspects are much more important in practical use than the perfect inversion of the phase, provided the total impulse response keeps its minimum phase character in order to avoid any acoustic artifacts. In the compensation filters, only the minimum phase part of $\det H(j\omega)$, which is $h_{Min\Phi}$, may be inverted along with some regularization as the case may be.

Furthermore, directional loudspeakers, i.e., loudspeakers that concentrate acoustic energy to the listening position, may be employed in order to enhance the crosstalk attenuation. While directional loudspeakers exhibit their peak performance in terms of crosstalk attenuation at higher frequencies, e.g., >1 kHz, inverse filters excel in particular at lower frequencies, e.g., <1 kHz, so that both measures complement each other. However, it is still difficult to design systems of a higher order than 4×4, such as 8×8 systems. The difficulties may result from ill-conditioned RIR matrices or from limited processing resources.

Figure 3:
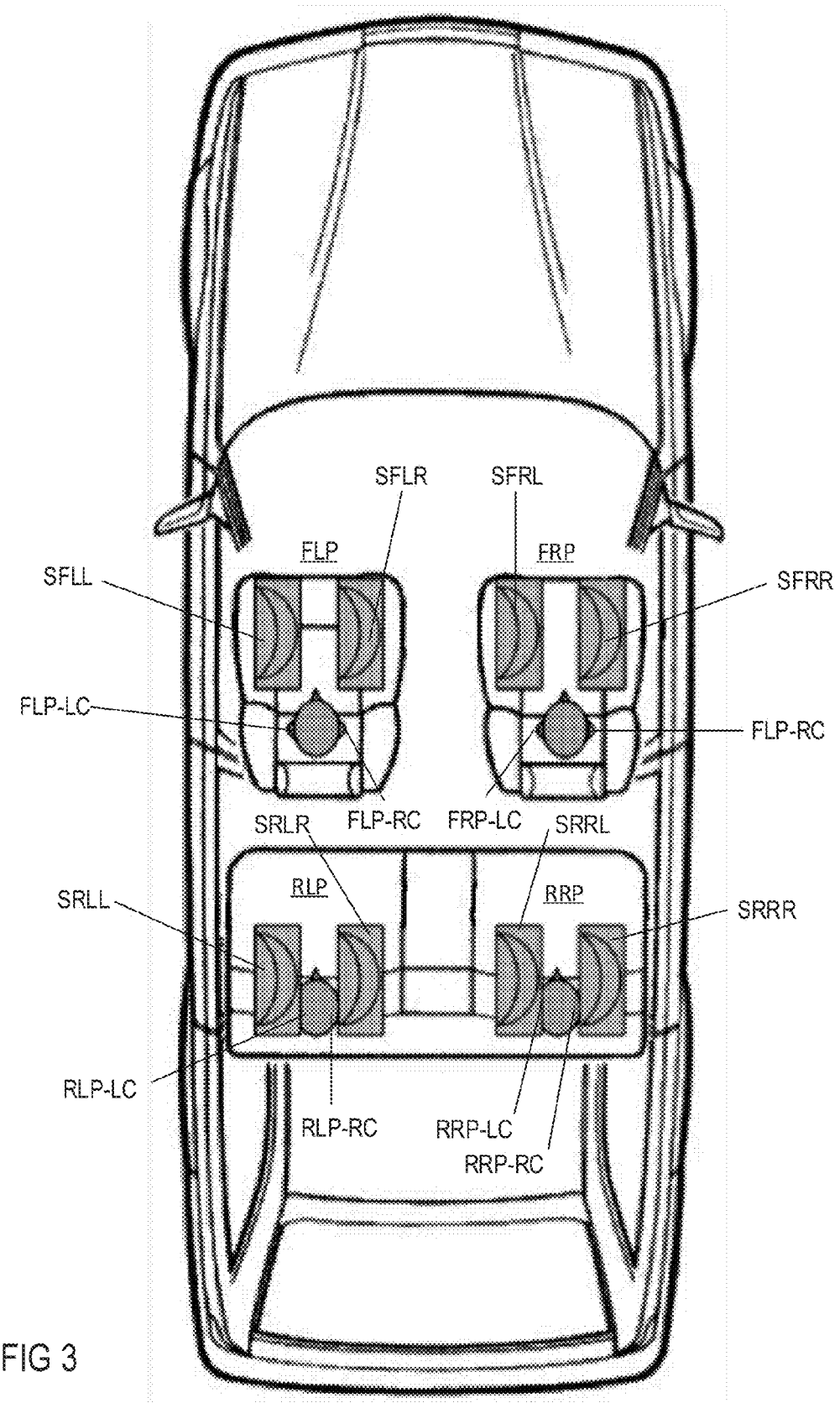
FIG. 3 is a schematic diagram illustrating a cabin of a car with four binaural sound zones and loudspeakers integrated into the roof liner of the car cabin.

Referring now to FIG. 3, an exemplary 8×8 system may include four listening positions in a car cabin: front left listening position FLP, front right listening position FRP, rear left listening position RLP and a rear right listening position RRP. At each listening position FLP, FRP, RLP and RRP, a stereo signal with left and right channels shall be reproduced so that a binaural audio signal shall be received at each listening position: front left position left and right channels FLP-LC and FLP-RC, front right position left and right channels FRP-LC and FRP-RC, rear left position left and right channels RLP-LC and RLP-RC and rear right position left and right channels RRP-LC and RRP-RC. Each channel may include a loudspeaker or a group of loudspeakers of the same type or a different type, such as woofers, midrange loudspeakers and tweeters. For accurate measurement purposes, microphones (not shown) may be mounted in the positions of an average listener's ears when sitting in the listening positions FLP, FRP, RLP and RRP. In the present case, shallow loudspeakers are integrated into the roof liner, left and right above the listening positions FLP, FRP, RLP and RRP. In particular, two loudspeakers SFLL and SFLR may be arranged close to position FLP, two loudspeakers SFRL and SFRR close to position FRP, two loudspeakers SRLL and SRLR close to position RLP and two loudspeakers SRRL and SRRR close to position RRP. The loudspeakers may be slanted in order to increase crosstalk attenuation between the front and rear sections of the car cabin. The distance between the listener's ears and the corresponding loudspeakers may be kept as short as possible to increase the efficiency of the inverse filters.

Figure 4:
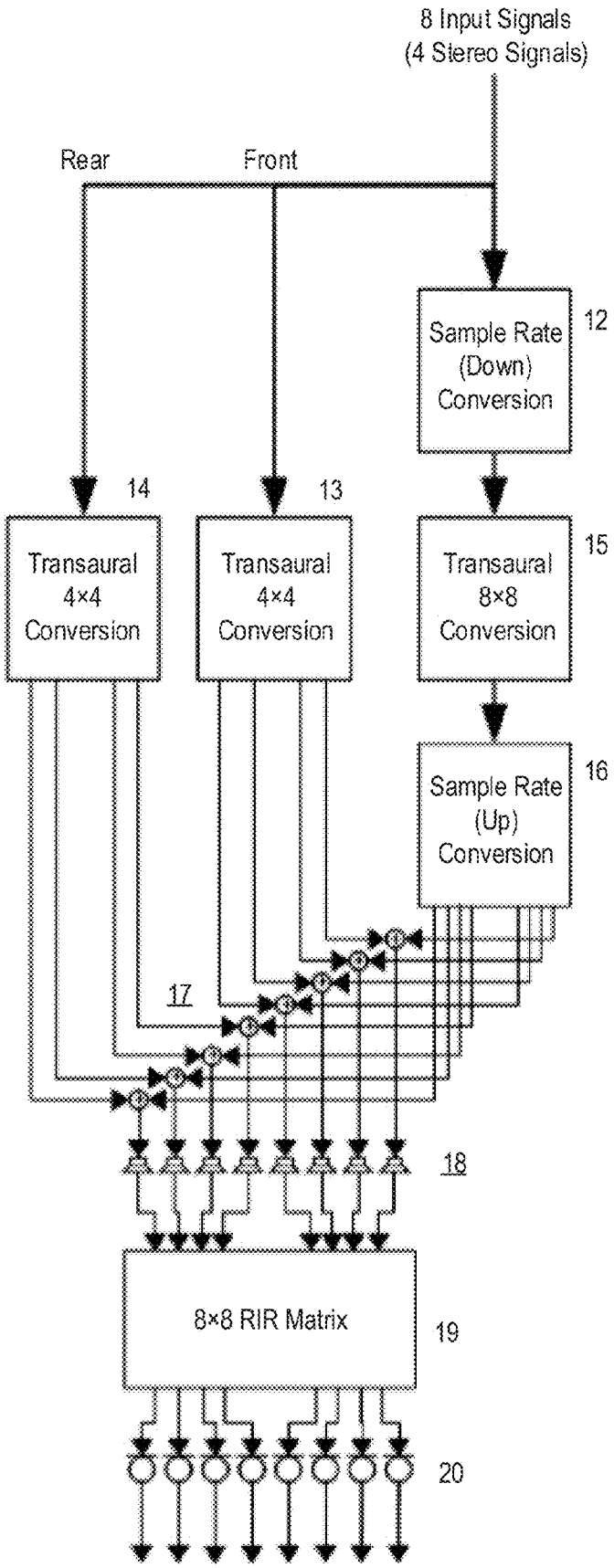
FIG. 4 is a block diagram illustrating an 8×8 processing arrangement and method for a system of FIG. 3, including two 4×4 and one 8×8 inverse filter matrices.

FIG. 4 illustrates a processing system implementing a processing method applicable in connection with the loudspeaker arrangement shown in FIG. 3. The system has four stereo input channels, i.e., eight single channels. All eight channels are supplied to sample rate down-converter 12. Furthermore, the four front channel signals thereof, which are intended to be reproduced by loudspeakers SFLL, SFLR, SFRL and SFRR, are supplied to 4×4 transaural processing unit 13 and the four rear channel signals thereof, which are intended to be reproduced by loudspeakers SRLL, SRLR, SRRL and SRRR, are supplied to 4×4 transaural processing unit 14. The down-sampled eight channels are supplied to 8×8 transaural processing unit 15 and, upon processing therein, to sample rate up-converter 16. The processed signals of the eight channels of sample rate up-converter 16 are each added with the corresponding processed signals of the four channels of transaural processing unit 13 and the four channels of transaural processing unit 14 by way of an adding unit 17 to provide the signals reproduced by loudspeaker array 18 with loudspeakers SFLL, SFLR, SFRL, SFRR, SRLL, SRLR, SRRL and SRRR. These signals are transmitted according to RIR matrix 19 to microphone array 20 with eight microphones that represent the eight ears of the four listeners and that provide signals representing reception signals/channels FLP-LC, FLP-RC, FRP-LC, FRP-RC, RLP-LC, RLP-RC, RRP-LC and RRP-RC. Inverse filtering by 8×8 transaural processing unit 15, 4×4 transaural processing unit 13 and 4×4 transaural processing unit 14 is configured to compensate for RIR matrix 19 so that each of the sound signals received by the microphones of microphone array 20 corresponds to a particular one of the eight electrical audio signals input in the system, and the other reception sound signal corresponds to the other electrical audio signal.

In processing systems and methods like the system and method shown in FIG. 4, there may be a certain overlap (cross talk) of the output signals provided by the 8×8 transaural processing unit 15 and the 4×4 transaural processing units 13 and 14. One way to avoid such overlap is to design the filter matrices representing the 8×8 transaural processing unit 15 (8×8 matrix) and the 4×4 transaural processing units 13 and 14 (4×4 matrices) dependent on each other. In the exemplary system and method described above in connection with FIG. 4, however, the matrices are designed independently of each other. Instead, certain restrictions (e.g., spectral and spatial restrictions) are introduced in the acoustic/electrical signal paths containing the 8×8 transaural processing unit 15 and the 4×4 transaural processing units 13 and 14 in order to reduce or avoid the overlap.

The spectral restriction may be implemented by adding additional filters (e.g., lowpass filters and highpass filters) arranged in the respective signal paths or by designing the matrices of the transaural processing unit 13, 14 and 15 accordingly or to use loudspeakers with limited frequency ranges. The spatial restriction may be implemented by employing directional acoustic sources that concentrate acoustic energy to a particular listening position so that cross talk between different listening positions is minimized. The acoustic/electrical signal path containing the 8×8 matrix may be restricted to lower frequencies and the acoustic/electrical signal path containing the 4×4 matrices may be restricted to middle and higher frequencies. But even when using broadband loudspeakers, their spatial behavior is different at lower frequencies and higher frequencies. At lower frequencies there is little or no directivity and, thus, little cross talk cancellation between the loudspeakers at a certain listening position. At higher frequencies the directivity is much better and, thus, cross talk cancellation between the loudspeakers is higher. At lower frequencies the 8×8 matrix applies and no spatial concentration of the acoustic energy takes place. At higher frequencies the 4×4 matrices apply and the respective energies are concentrated to, e.g., the front listening positions and the rear listening positions of a car cabin.

Figure 5:
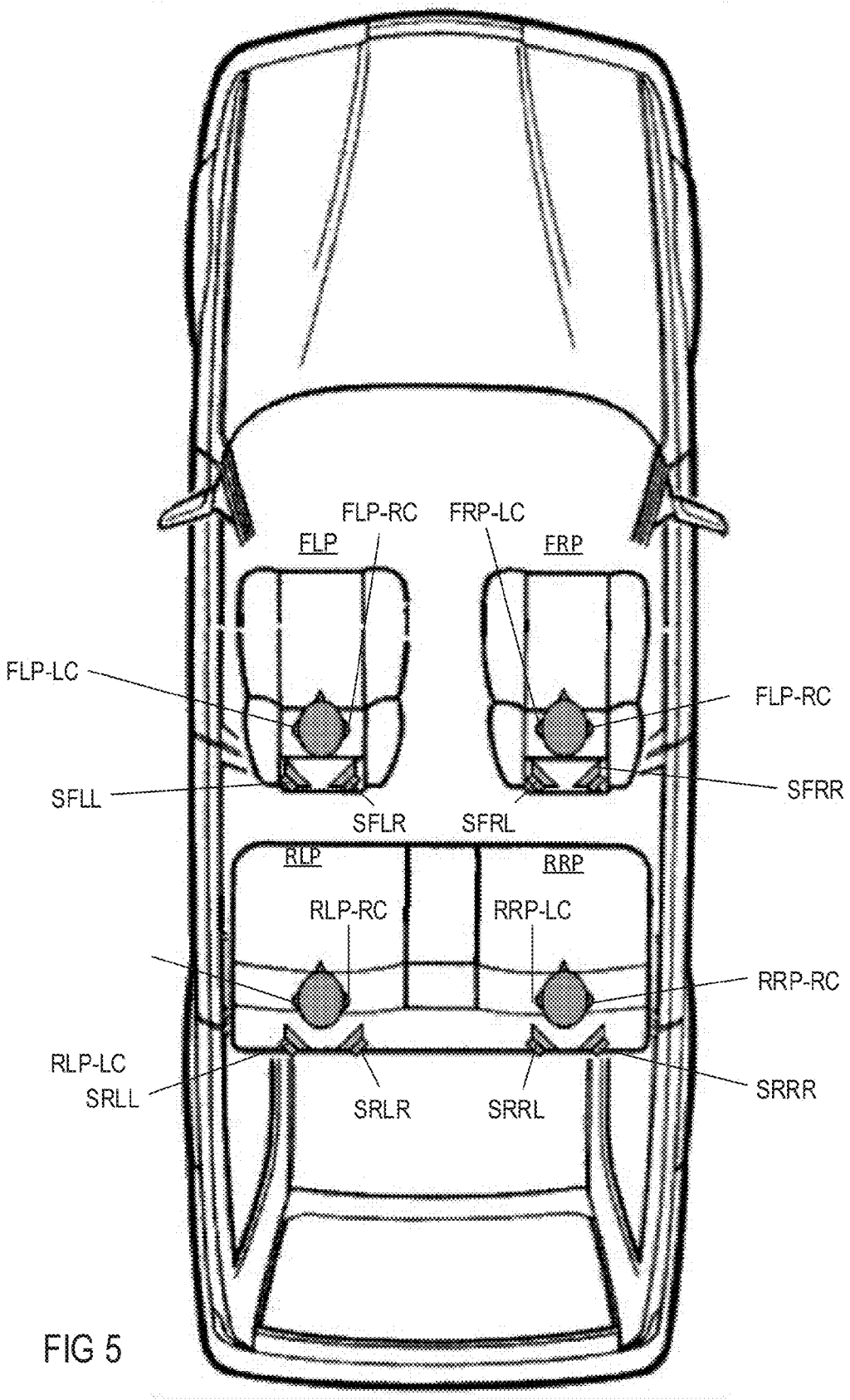
FIG. 5 is a schematic diagram illustrating a cabin of a car with four binaural sound zones and loudspeakers integrated into headrests of seats in the car cabin.
Figure 6:
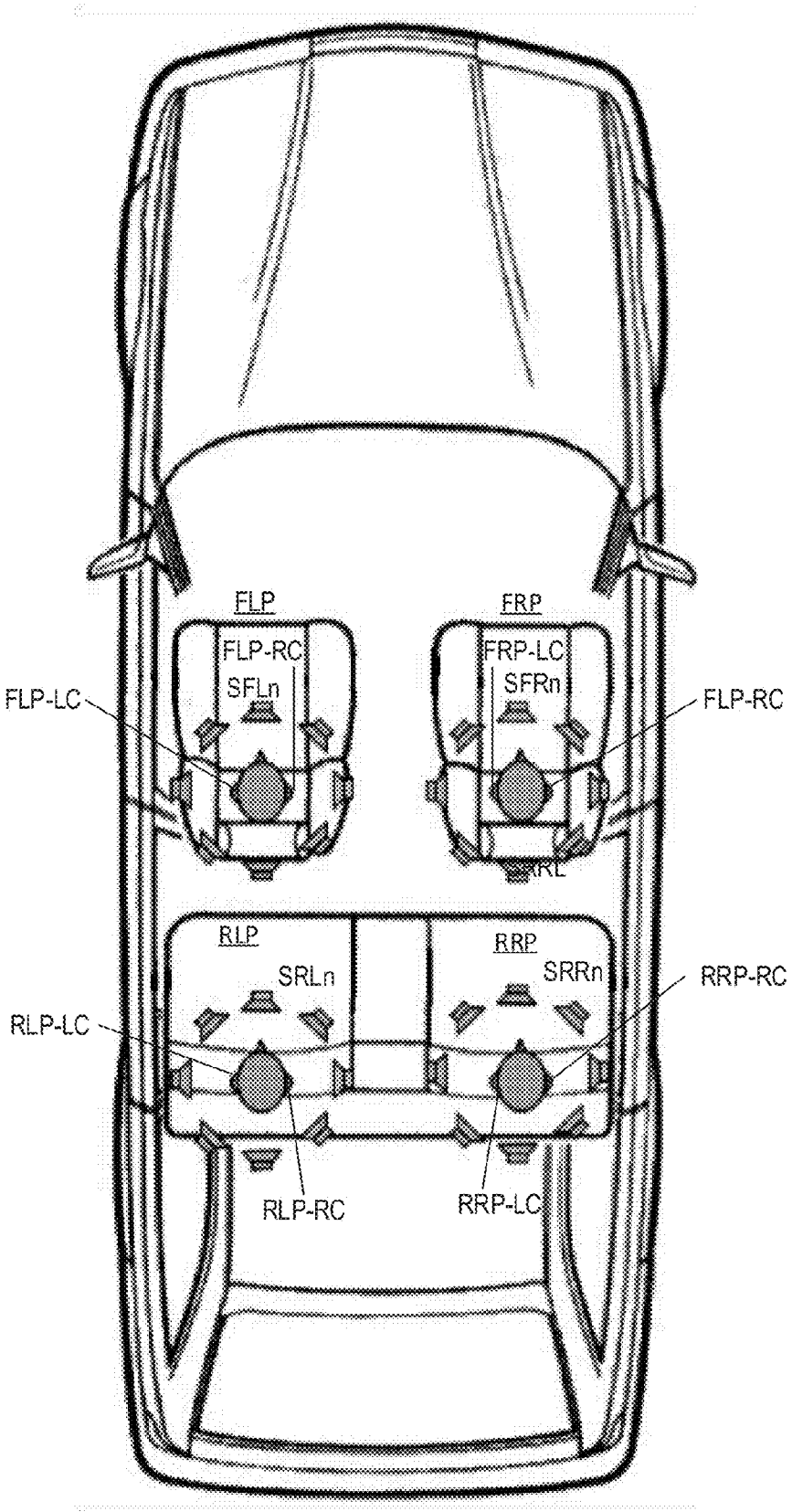
FIG. 6 is a schematic diagram illustrating a car cabin with at least four binaural sound zones and loudspeakers arranged around a listener's head position.

In order to further improve the crosstalk attenuation at higher frequencies, directional loudspeakers may be used. As already outlined above, directional loudspeakers are loudspeakers that concentrate acoustic energy to a particular listening position. The distance between the listener's ears and the corresponding loudspeakers may be kept as short as possible to further increase the efficiency of the inverse filters. Alternatively, to integrate loudspeakers SFLL, SFLR, SFRL, SFRR, SRLL, SRLR, SRRL and SRRR into the roof lining, they may be integrated into the headrests of the seats of the listeners, as shown in FIG. 5, whereby the distance between the listener's ears and the corresponding loudspeakers is further reduced and the headrests of the front seats would provide further crosstalk attenuation between the front seats and the rear seats. In another alternative arrangement, a multiplicity of 4 n loudspeakers SFLn, SFRn, SRLn and SRRn may be arranged around the listener's head (e.g., also mounted in the head liner of the car), as shown in FIG. 6. Such an array may be grouped or combined with at least one beamforming and/or head-tracking arrangement to provide an increased dimension of the matrices, which is in the present case higher than 4×4 and 8×8. Instead of a broadband loudspeaker, a group of loudspeakers operating or operated in different frequency ranges may be used as well.

In the system of FIG. 4, 8×8 transaural processing unit 15 is operated at a lower sampling rate than 4×4 transaural processing units 13 and 14 due to the lower frequency range of the processed signals, by which the system is more resource efficient. The 4×4 transaural processing units 13 and 14 may be operated over the complete useful frequency range (or a higher frequency range) and thus allow for more sufficient crosstalk attenuation over the complete useful frequency range compared to 8×8 transaural processing. The lower frequency limit of the higher frequency range is the same as or higher than the upper frequency limit of the lower frequency range. The upper frequency limit of the lower frequency range is lower than the upper frequency limits of the complete useful frequency range and the higher frequency range. The frequency ranges corresponding to the 4×4 transaural processing units 13 and 14 may be the same or different.

The matrices of the 8×8 transaural processing unit 15 and the 4×4 transaural processing units 13 and 14 are determined such that they provide, in connection with the transfer characteristics of the loudspeakers and other elements in the respective signal path, the inverse of the room transfer matrix in order to compensate for the transfer matrix so that each of the reception sound signals corresponds to one of the electrical audio signals. It has to be noted that the spectral characteristic of the regularization parameter may correspond to the characteristics of the channel under investigation.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A sound system for acoustically reproducing k electrical audio signals, where k≥2, and establishing k sound zones, in each of which one of k reception sound signals occurs that is an individual pattern of the reproduced and transmitted k electrical audio signals, the system comprising:

a signal processing arrangement that is configured to process the k electrical audio signals to provide k processed electrical audio signals; and k loudspeakers that are arranged at positions separate from each other and within or adjacent to the k sound zones, each configured to convert the k processed electrical audio signals into corresponding k acoustic audio signals; where each of the k acoustic audio signals is transferred according to a transfer matrix from each of the k loudspeakers to each of the k sound zones, where the k transferred acoustic audio signals contribute to the corresponding reception sound signals;

wherein said processing of the k electrical audio signals, which provides k processed electrical audio signals, comprises inverse filtering according to three filter matrices, one of which is an i×i filter matrix, one is a j×j filter matrix and one is a k×k filter matrix, in which i, j <k;

each of the i×i matrix and j×j filter matrix is configured to digitally process a share of the k electrical audio signals in a first frequency range or at a first sampling rate or both, or in a second frequency range or at a second sampling rate or both, respectively, and the k×k filter matrix is configured to digitally process all k electrical audio signals in a third frequency range or at a third sampling rate, the third sampling rate being the lowest of the three sampling rates and an upper frequency limit of the third frequency range being lower than upper frequency limits of the first frequency range and the second frequency range; and the three filter matrices are configured to compensate for the transfer matrix so that each of the reception sound signals corresponds to one of the electrical audio signals.

2. The system of claim 1, where k=2n and n≥1 and the k electrical audio signals are configured to form n stereo signals and the n reception sound signals are configured to form k/2 binaural signals.

3. The system of claim 1, further comprising at least one of additional loudspeaker(s), additional sound zone(s), additional listening position(s) and matrices with increased dimensions.

4. The system of claim 1, where at least some of the loudspeakers are part of a group of loudspeakers, each group comprising at least two loudspeakers.

5. The system of claim 1, where the loudspeakers or the groups of loudspeakers are arranged in the roof liner or the head rest of a car cabin.

6. The system of claim 1, where the loudspeakers or the groups of loudspeakers are arranged around the position of a listener's head.

7. The system of claim 1, where some of the listening positions are arranged in above or in front of front seats in a car cabin and one of the i×i and j×j matrices relates to these listening positions.

8. The system of claim 1, where at least one of the loudspeakers is a directional loudspeaker.

9. A method for acoustically reproducing k electrical audio signals, where k≥2, and establishing k sound zones in each of which one of k reception sound signal occurs that is an individual pattern of the reproduced and transmitted k electrical audio signals, the method comprising :

processing the k electrical audio signals to provide k processed electrical audio signals; and converting the k processed electrical audio signals into corresponding k acoustic audio signals with k loudspeakers that are arranged at positions separate from each other and within or adjacent to the k sound zones; where each of the k acoustic audio signals is transferred according to a transfer matrix from each of the k loudspeakers to each of the k listening positions where the k transferred acoustic audio signals contribute to the reception sound signals;

wherein said processing of the k electrical audio signals, which provides k processed electrical audio signals, comprises inverse filtering according to three filter matrices, one of which is an i×i filter matrix, one is an j×j filter matrix and one is a k×k filter matrix, in which i, j<k;

each of the i×i matrix and j×j filter matrix is configured to digitally process a share of the k electrical audio signals in a first frequency range or at a first sampling rate or both, or in a second frequency range or at a second sampling rate or both, respectively, and the k×k filter matrix is configured to digitally process all k electrical audio signals in a third frequency range or at a third sampling rate, the third sampling rate being the lowest of the three sampling rates and an upper frequency limit of the third frequency range being lower than upper frequency limits of the first frequency range and the second frequency range; and the three filter matrices are configured to compensate for the transfer matrix so that each one of the reception sound signals corresponds to one of the electrical audio signals.

10. The method of claim 9, where k=2n and n≥1 and the k electrical audio signals are configured to form n stereo signals and the n reception sound signal are configured to form k/2 binaural signals.

11. The method of claim 9, further comprising at least one of additional loudspeaker(s), additional sound zone(s), additional listening position(s), and matrices with increased dimensions.

12. The method of claim 9, where the at least some of the loudspeakers are part of a group of loudspeakers, each group comprising at least two loudspeakers.

13. The method of claim 9, where the loudspeakers or the groups of loudspeakers are arranged in the roof liner or the headrest of a car cabin.

14. The method of claim 9, where some of the listening positions are arranged in, above or in front of front seats in a car cabin and one of the 4×4 matrices relates to these listening positions.

15. The method of claim 9, where at least one of the loudspeakers is a directional loudspeaker.

* * * * *